US011353285B2

(12) United States Patent
Iskhakov et al.

(10) Patent No.: US 11,353,285 B2
(45) Date of Patent: Jun. 7, 2022

(54) BALLISTIC DEFLECTION DEVICE

(71) Applicants: Igor Iskhakov, Oakville, CT (US); Yuriy Yuabov, Waterbury, CT (US)

(72) Inventors: Igor Iskhakov, Oakville, CT (US); Yuriy Yuabov, Waterbury, CT (US)

( * ) Notice: Subject to any disclaimer, the term of this patent is extended or adjusted under 35 U.S.C. 154(b) by 71 days.

(21) Appl. No.: 17/083,082

(22) Filed: Oct. 28, 2020

(65) Prior Publication Data

US 2022/0128333 A1 Apr. 28, 2022

(51) Int. Cl.
*F41C 33/04* (2006.01)
*F41H 5/08* (2006.01)

(52) U.S. Cl.
CPC ..... *F41C 33/04* (2013.01); *F41H 5/08* (2013.01)

(58) Field of Classification Search
CPC ..... F41C 33/04; F41C 33/041; F41H 5/08
See application file for complete search history.

(56) References Cited

U.S. PATENT DOCUMENTS

| | | | | | |
|---|---|---|---|---|---|
| 4,777,753 | A * | 10/1988 | Stancato | F41J 13/00 | 42/70.11 |
| 5,111,545 | A * | 5/1992 | Krozal | F41C 33/041 | 224/675 |
| D359,439 | S * | 6/1995 | Osbern | D8/354 | |
| 6,128,847 | A * | 10/2000 | Langner | F41A 17/54 | 42/70.07 |
| 10,393,478 | B2 * | 8/2019 | Romano | F41C 33/02 | |
| 10,670,378 | B1 * | 6/2020 | Lee | F41C 33/0209 | |
| 11,015,899 | B2 * | 5/2021 | Romano | A45F 5/021 | |
| 11,248,875 | B2 * | 2/2022 | Evans | F42B 39/02 | |
| 2012/0061432 | A1 * | 3/2012 | Novak | F41C 33/04 | 224/243 |
| 2021/0285741 | A1 * | 9/2021 | Romano | B29C 65/601 | |

* cited by examiner

*Primary Examiner* — Justin M Larson
(74) *Attorney, Agent, or Firm* — Volpe Koenig

(57) ABSTRACT

A ballistic deflection device including a backing plate configured to be attached to a holster, a ballistic deflection section coupled to a bottom portion of the backing plate, wherein the ballistic deflection section includes a first side wall, a second side wall projecting, and rear wall, wherein the rear wall is defines a non-zero angle with respect to the backing plate.

20 Claims, 8 Drawing Sheets

BALLISTIC DEFLECTION DEVICE

BACKGROUND

Technological Field

The present disclosure relates to a ballistic deflection device, and more particularly to a ballistic deflection device to be used in conjunction with a gun holster.

Description of Related Art

Currently, firearm users who carry a firearm on their person in a concealed or non-concealed manner have a number of choices for holstering and carrying their weapon. These options can be made of hard or soft materials. The holster can also be attached to many locations on a user's body using a carrying device, including, for example, a belt, waistband, a vest, chest rig, ankle holster or a thigh harness. In the course of inserting or withdrawing the firearm from the holster, it is possible to unintentionally actuate the firearm trigger either by the user or by a foreign object. This actuation of the trigger creates an unintentional discharge of the weapon. An unintentional discharge of the weapon can also occur, without an outside actor, if a round is chambered in the barrel. This can occur through either a faulty primer in the bullet itself, or some flaw in the trigger mechanism of the firearm. Since the holster is attached to the user's body, this event may cause injury or death to the firearm user. To minimize this type of occurrence, many firearms are designed with safety mechanisms that prohibit the weapon from being discharged, even if the trigger is pulled. However, the use of a safety mechanism may impair the user's ability to operate the firearm so the user may choose not to engage the mechanism or disengage it during use. Other firearms in regular use do not even contain such safety mechanisms or have a safety that can be easily actuated by a foreign object. For these reasons and others, firearm discharge inside a holster is a serious problem for users.

Thus, a need exists for a firearm holster that incorporates a protective material, is constructed in a seamless manner, is compatible with various attachments for seamless transition between holsters, and can withstand multiple discharges. There is a further need for a firearm holster that is comfortable to carry on a user's body while being sturdy and able to withstand harsh conditions. The present disclosure may provide a solution for at least one of these remaining challenges.

SUMMARY OF THE INVENTION

A ballistic deflection device including a backing plate configured to be attached to a holster is disclosed. The device includes a ballistic deflection section coupled to a bottom portion of the backing plate, wherein the ballistic deflection section includes a first sidewall, a second sidewall, and a rear wall, wherein the rear wall is defines a non-zero angle with respect to the backing plate. The first sidewall can include a curve at meeting of the first sidewall and the rear wall and the second sidewall includes a curve at meeting of the first sidewall and the rear wall. The first sidewall can be angled towards a center of the rear wall of the ballistic deflection section. The second sidewall can be angled towards a center of the rear wall of the ballistic deflection section. The first sidewall and the second sidewall can be connected by a front wall, wherein the first side wall, the second side wall, the rear wall, and the front wall define a ballistic chamber for mating with a firearm barrel, and wherein the ballistic chamber narrows from a first end to a second end.

The first sidewall and the second sidewall can define a shorter length than a length of the backing plate. The first sidewall and the second sidewall can define a larger width than a width of the backing plate. The backing plate can include at least a first aperture and a second aperture for linking the ballistic deflection device to a holster and include a third aperture and a fourth aperture, wherein the first aperture and the second aperture define a first axis, and the third aperture and the fourth aperture defined a second axis. The first axis can be perpendicular to the second axis. The third aperture can be between the first aperture and the fourth aperture. The third aperture can be elongated perpendicular to the second axis.

At least a portion of the rear wall can include a resin layer, and at least a portion of the first sidewall and at least a portion of the second sidewall can include the resin layer. The device can include a material having a Brinell hardness at least 550.

A ballistic deflection system intended to protect a user from injury when inserting or removing a firearm from a holster comprising is also disclosed including a holster for a handgun, a backing plate coupled to the holster, wherein at least a first portion of the backing plate is parallel to the holster, and a second portion of the backing plate is angled from the first portion of the backing plate below the holster. The backing plate can be attached to an outer side of the holster between the holster and a user's leg.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION

Figure 1:
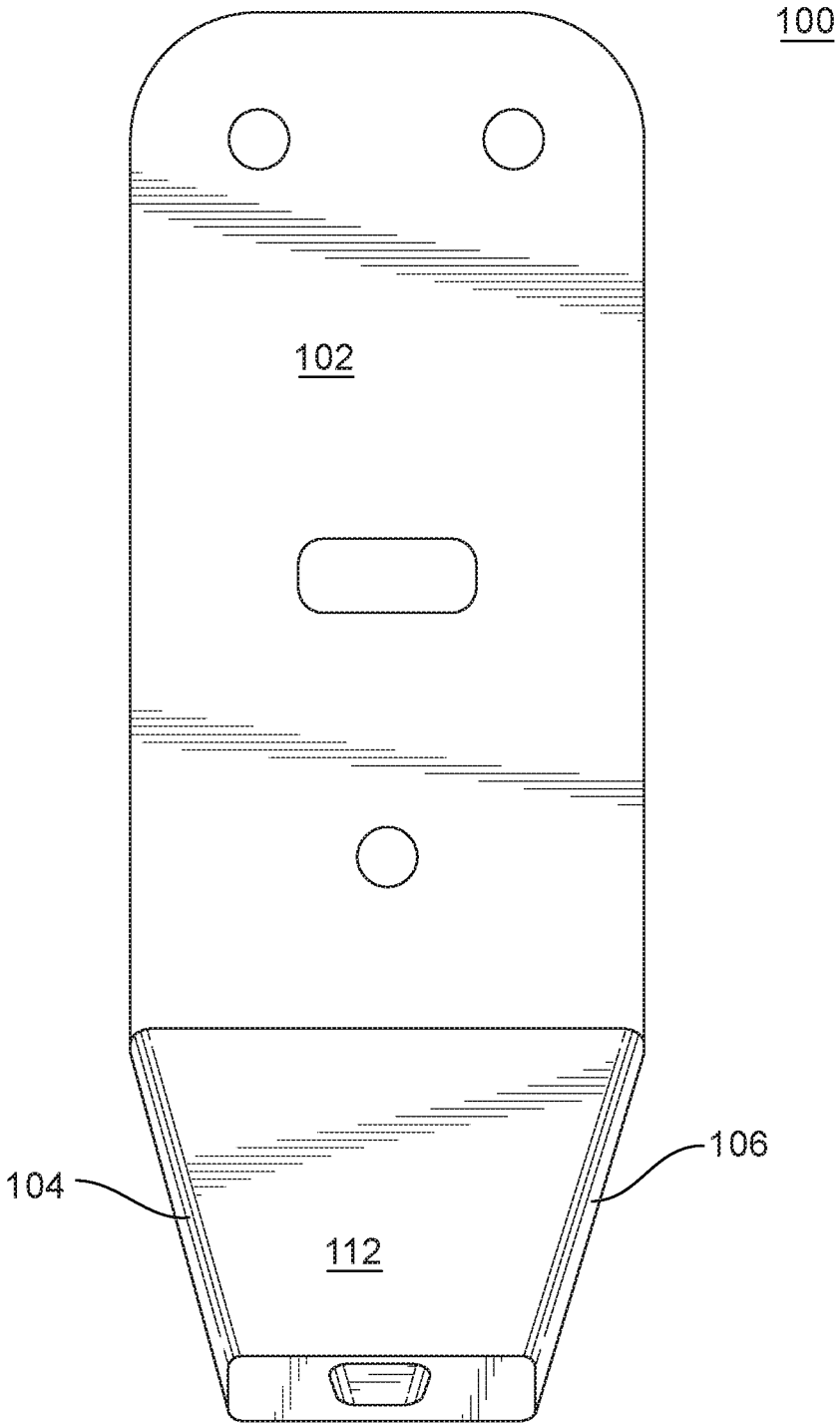
FIG. 1 is a perspective view of an embodiment of a ballistic deflection device according to the disclosure.

Reference will now be made to the drawings wherein like reference numerals identify similar structural features or aspects of the subject invention. For purposes of explanation and illustration, and not limitation, a partial view of an exemplary embodiment of a ballistic deflection device in accordance with the invention is shown in FIG. 1 and is designated generally by reference character 100. Other embodiments of the deflection device in accordance with the invention, or aspects thereof, are provided in FIGS. 2-7, as will be described. The methods and systems of the invention can be used to deflect or capture ballistics from handguns fired inadvertently while housed in holsters.

FIG. 1 shows a ballistic deflection device 100. The device 100 includes a backing plate 102 meant to be attached to a holster, which can be worn on a thigh of an owner or user. The device 100 further includes a ballistic deflection section 114, which can be integral or coupled to the bottom portion of the backing plate 102. The ballistic deflection section 114 is meant to sit below a barrel of a handgun, which is located inside the holster. If the firearm is accidentally or inadvertently discharged, the bullet or ballistic is meant to strike at least a portion of the deflection section 114, or the inside of either of the side walls 104 or 106 The deflection section 114 is not meant to corral the bullet but instead is meant to absorb only a portion of the energy and deflect the bullet. This is preferential to typical devices that attempt to capture the bullet, as the amount of energy carried by a ballistic is too high to be safely corralled. Further, the ballistic deflection device 100 includes a resin layer. The resin can cover a portion of the deflection section 114, where a bullet is supposed to initially strike, leaving a portion of the deflection section uncovered. This allows a user to also know exactly where the bullet initially struck during a discharge. The resin layer also prevents sparks from occurring when a bullet or projectile strikes the deflection section 114 further preventing damage to the device 100. It is also considered that the entirety of the device 100 can be covered in resin for production ease purposes. The ballistic deflection device 100 includes a material having a Brinell hardness of at least 550, Abrasion Resistant (AR) 550 steel is the preferred material.

Figure 2:
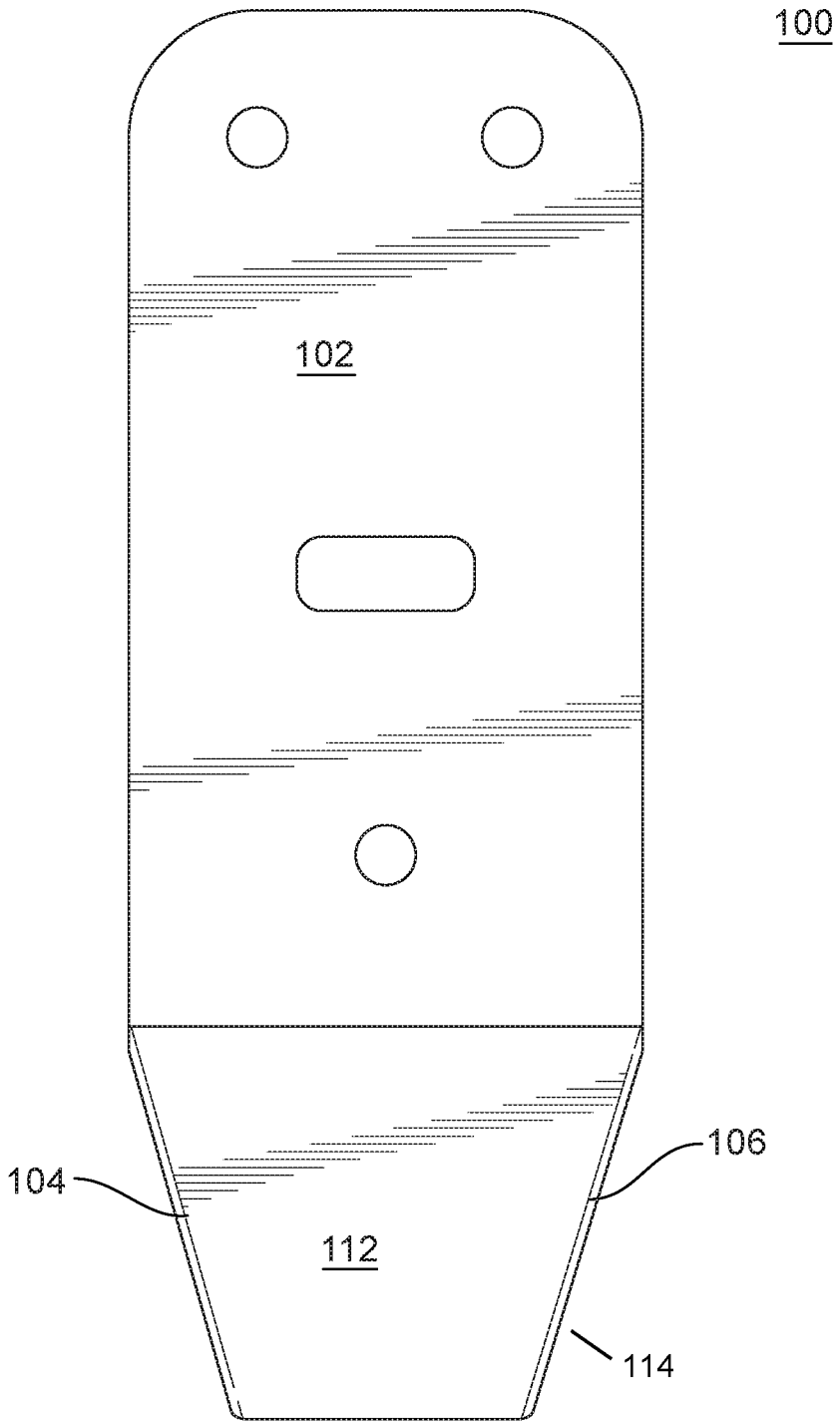
FIG. 2 is a front view of the ballistic deflection device of FIG. 1, showing a slope of the ballistic receiver.
Figure 3:
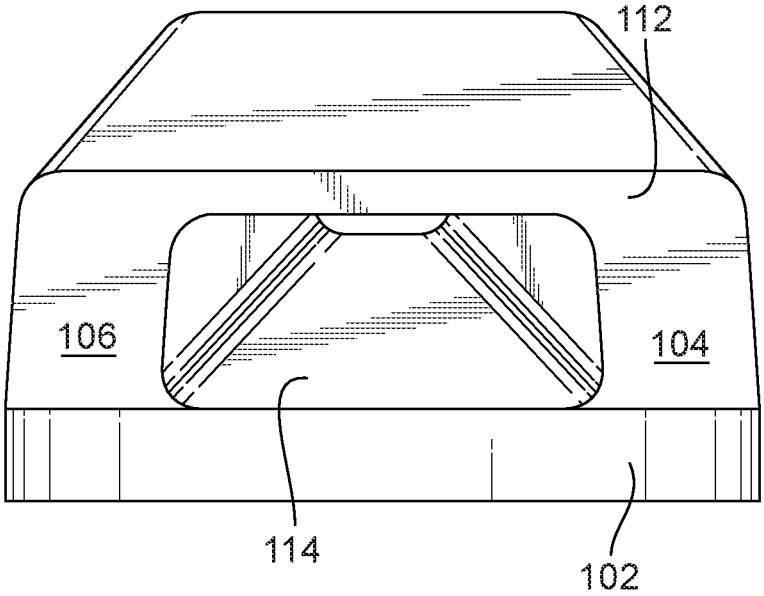
FIG. 3 is a top view of the ballistic deflection device of FIG. 1, showing the angled ballistic receiver.
Figure 4:
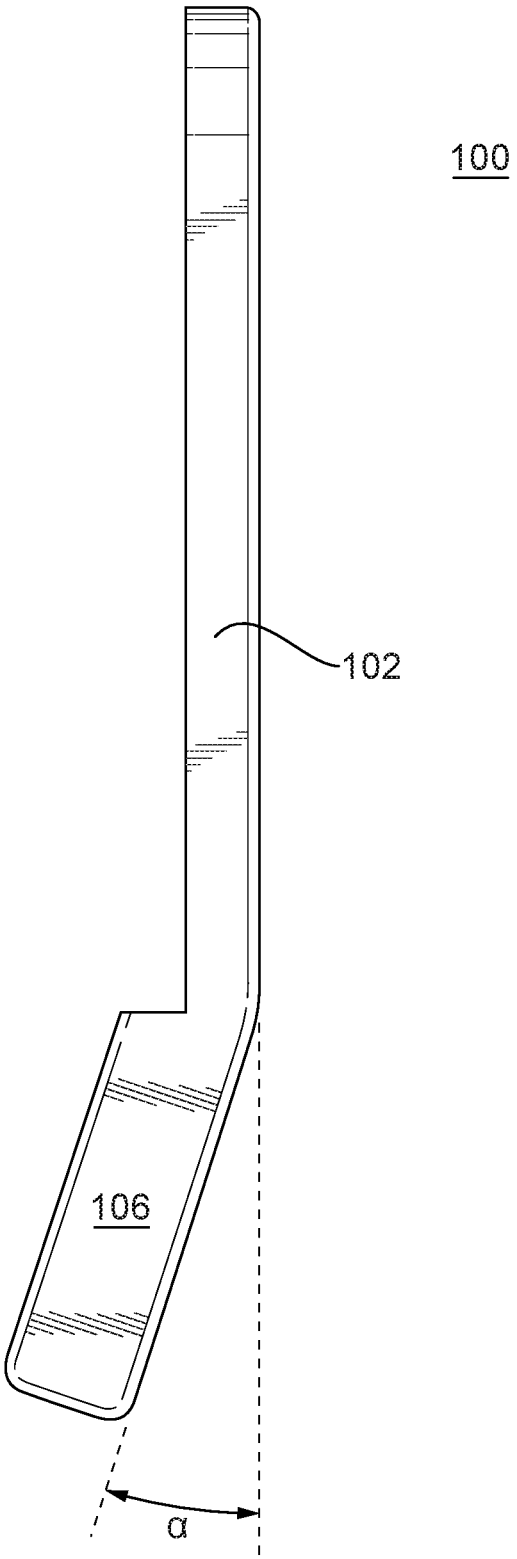
FIG. 4 is a side view of the ballistic deflection device of Fig.
Figure 5:
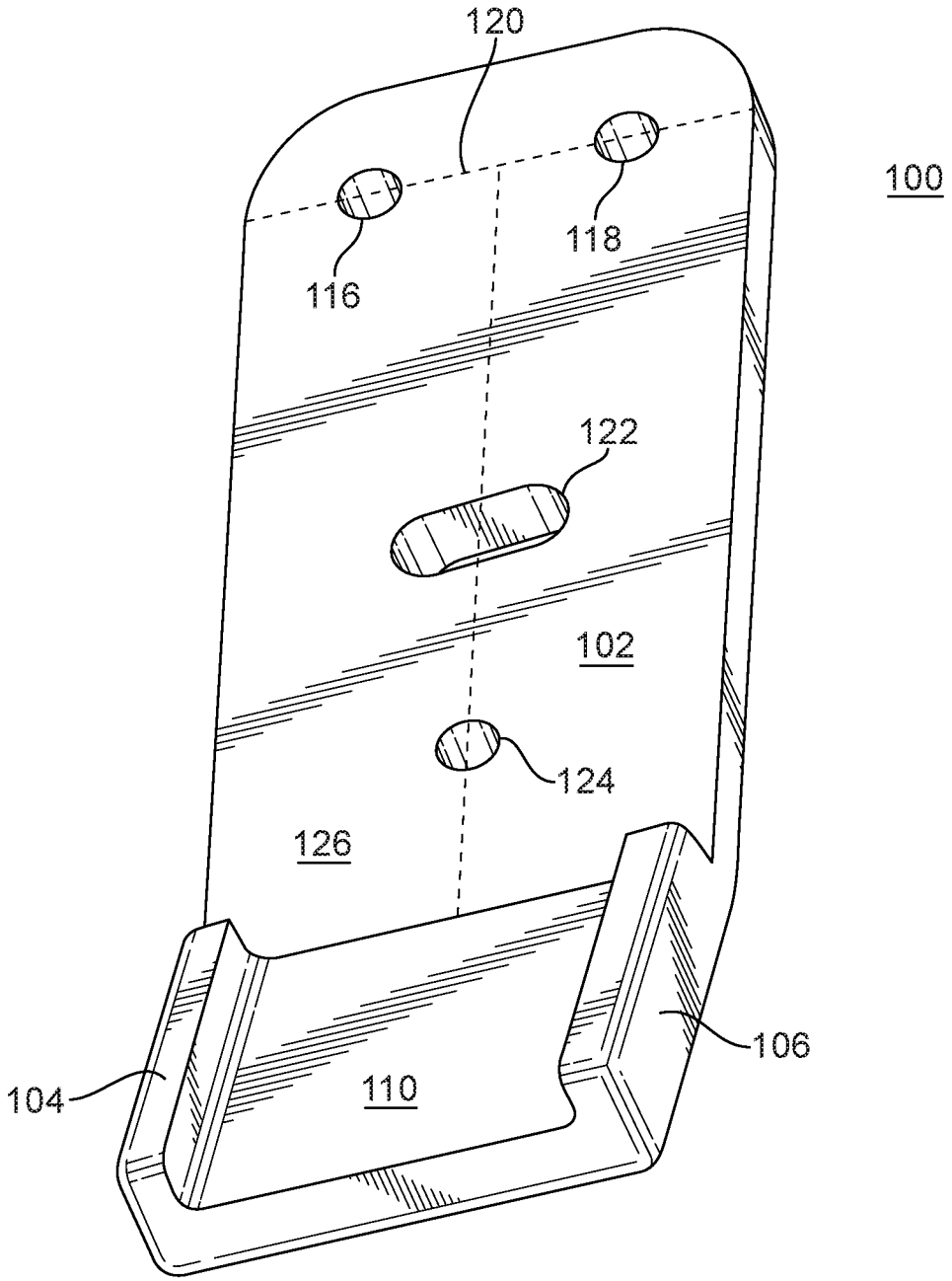
FIG. 5 is a perspective view of an embodiment of a ballistic deflection device according to the disclosure.
Figure 6:
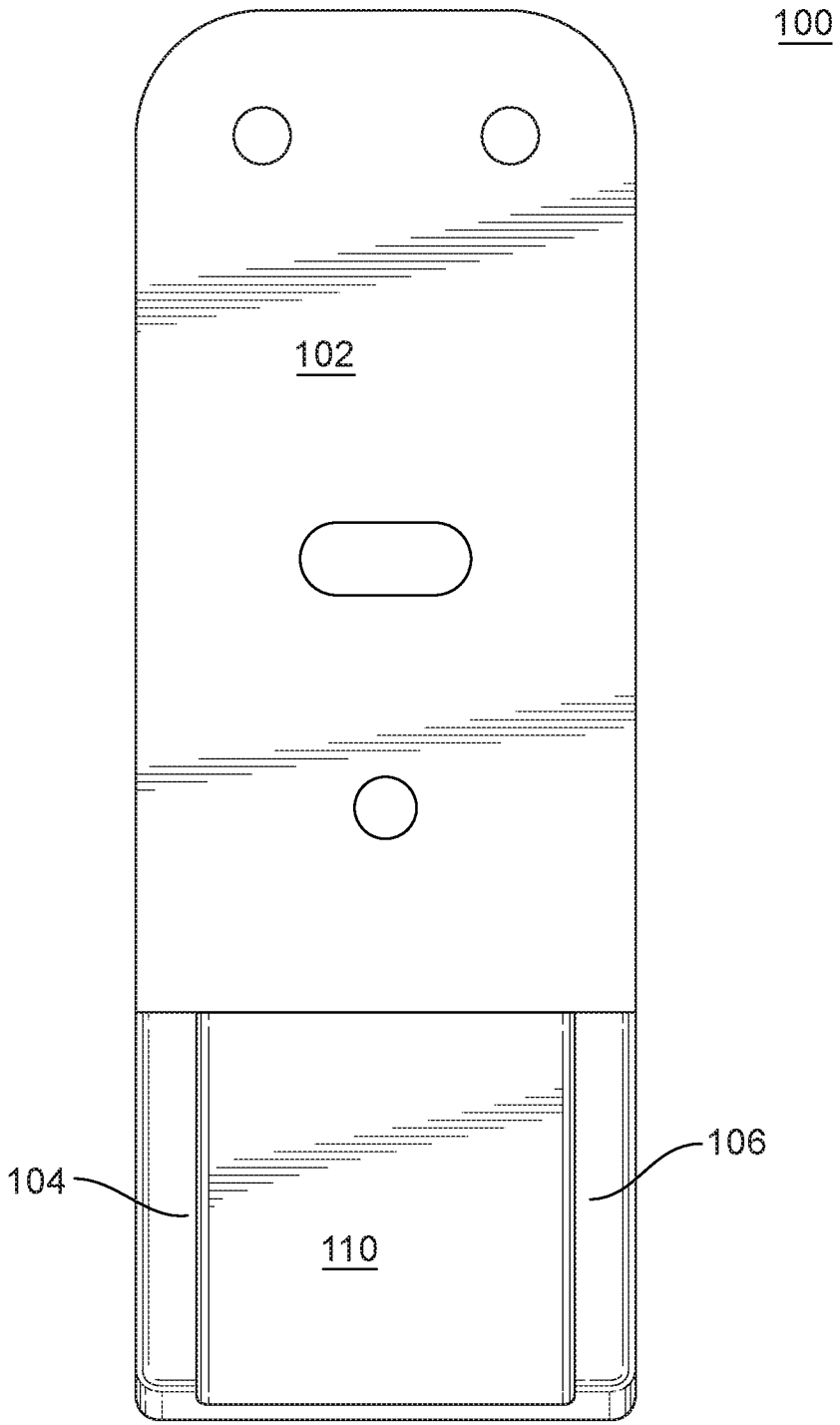
FIG. 6 is a front view of the ballistic deflection device of FIG. 5, showing a slope of the ballistic receiver.
Figure 7:
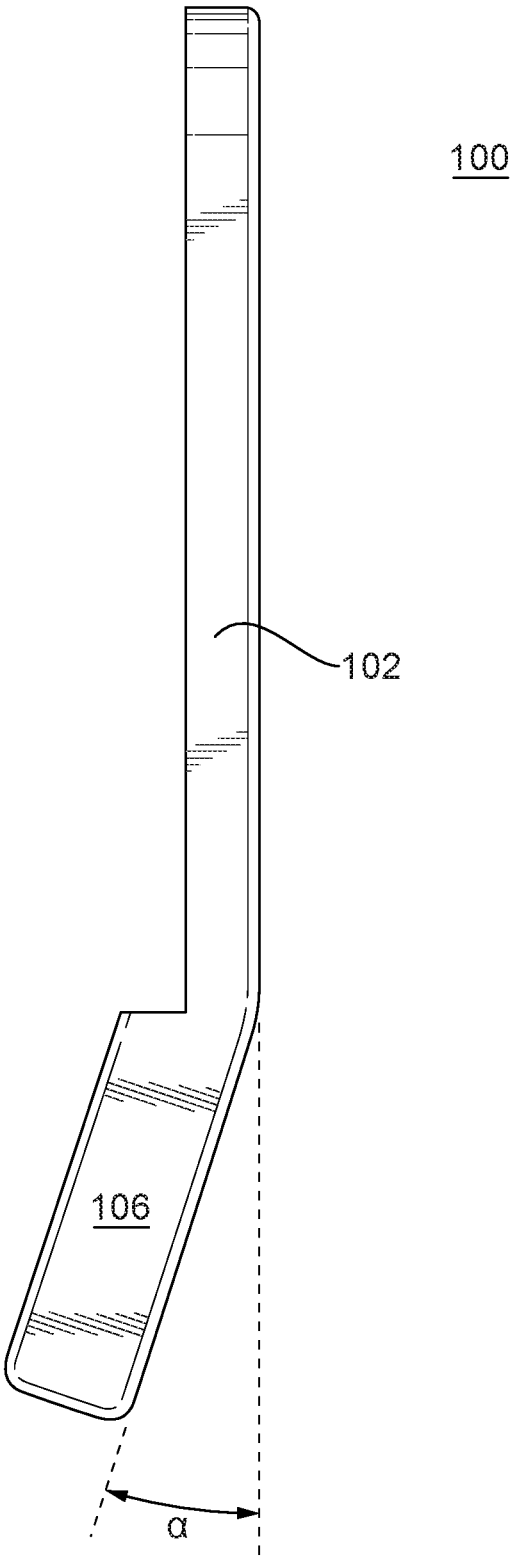
FIG. 7 is a side view of the ballistic deflection device of FIG. 5, showing the angled ballistic receiver.
Figure 8:
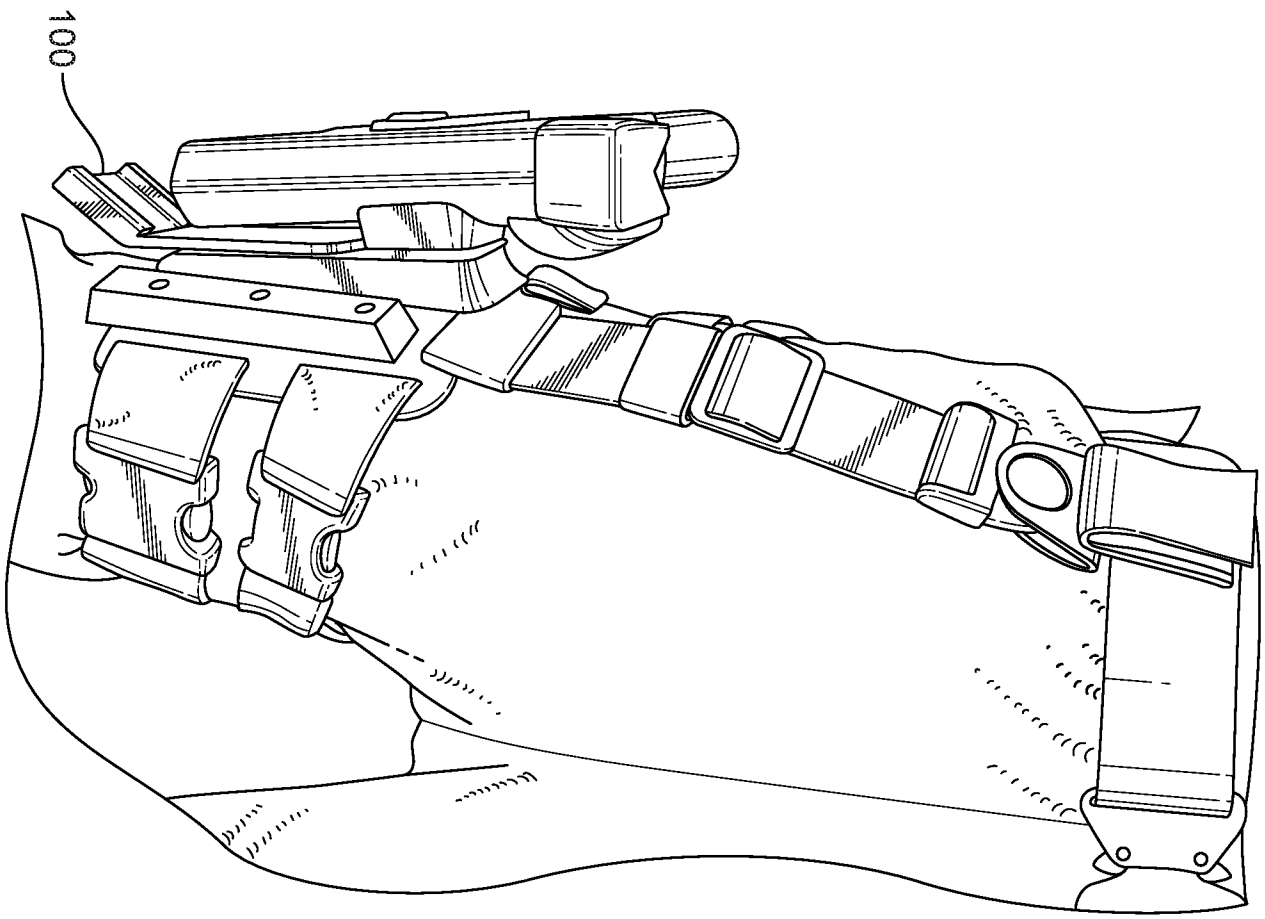
FIG. 8 shows a view of the ballistic deflection device in use.

FIGS. 2-4 show the first sidewall 104 and the second sidewall 106 meeting the rear wall 110 with a curve instead of a corner, which allows a bullet to graze away. The sidewalls 104/106 can be angled towards the center of the ballistic deflection section and are connected by a front wall 112, thus creating a ballistic chamber (Shown in in FIG. 3). The deflection section 114 includes a first sidewall 106 and a second sidewall 104 projecting from a rear wall 110. The rear wall 110 can be a continuation of the backing plate 102 but defines a non-zero angle with respect to the backing plate 102. The angle (a) (shown in FIGS. 4 and 7) is preferred to be between 45 and 89 degrees with respect to the backing plate, and specifically between 65 and 80 degrees. The chamber allows a bullet to bounce around and ultimately fall out the open bottom end, again allowing energy to slowly dissipate instead of fully capturing the entirety of the energy within the device. It is also considered that the sidewalls 106/104 are not connected by a second wall, and are only connected to each other by the rear wall 110, as shown in FIGS. 5-6. The sidewalls 106/104 are also considered to be parallel to each other, and not bow inwards.

FIGS. 1-7 further show the attachment system of the device 100 to a potential holster. The backing plate 102 includes a first aperture 116 and a second aperture 118 which are aligned along a first axis 120. A third aperture 122 and a fourth aperture 124 define a second axis 126 perpendicular to the first axis. The third aperture 122 is elongated perpendicular to the second axis 126 to provide further attachment flexibility to the backing plate 102.

The methods and systems of the present disclosure, as described above and shown in the drawings provide for a ballistic deflection device with superior properties including increased reliability and ease of use. While the apparatus and methods of the subject disclosure have been showing and described with reference to embodiments, those skilled in the art will readily appreciate that changes and/or modifications may be made thereto without departing from the spirit and score of the subject disclosure.

What is claimed is:

1. A ballistic deflection device comprising:

a backing plate configured to be attached to a holster;

a ballistic deflection section coupled to a bottom portion of the backing plate, wherein the ballistic deflection section includes a first sidewall, a second sidewall, and a rear wall, wherein the rear wall defines a non-zero angle with respect to the backing plate.

2. The ballistic deflection device of claim 1, wherein the first sidewall includes a curve at meeting of the first sidewall and the rear wall and the second sidewall includes a curve at meeting of the first sidewall and the rear wall.

3. The ballistic deflection device of claim 1, wherein the first sidewall is angled towards a center of the rear wall of the ballistic deflection section.

4. The ballistic deflection device of claim 1, wherein the second sidewall is angled towards a center of the rear wall of the ballistic deflection section.

5. The ballistic deflection device of claim 1, wherein the first sidewall and the second sidewall are connected by a front wall.

6. The ballistic deflection device of claim 5, wherein the first side wall, the second side wall, the rear wall, and the front wall define a ballistic chamber for mating with a firearm barrel.

7. The ballistic deflection device of claim 6, wherein the ballistic chamber narrows from a first end to a second end.

8. The ballistic deflection device of claim 1, wherein the first sidewall and the second sidewall define a shorter length than a length of the backing plate.

9. The ballistic deflection device of claim 1, wherein the first sidewall and the second sidewall define a larger width than a width of the backing plate.

10. The ballistic deflection device of claim 1, wherein the backing plate includes at least a first aperture and a second aperture for linking the ballistic deflection device to a holster.

11. The ballistic deflection device of claim 10, further comprising a third aperture and a fourth aperture, wherein the first aperture and the second aperture define a first axis, and the third aperture and the fourth aperture defined a second axis.

12. The ballistic deflection device of claim 11, wherein the first axis is perpendicular to the second axis.

13. The ballistic deflection device of claim 11, wherein the third aperture is between the first aperture and the fourth aperture.

14. The ballistic deflection device of claim 11, wherein the third aperture is elongated perpendicular to the second axis.

15. The ballistic deflection device of claim 1, wherein at least a portion of the rear wall includes a resin layer.

16. The ballistic deflection device of claim 15, wherein at least a portion of the first sidewall and at least a portion of the second sidewall includes the resin layer.

17. The ballistic deflection device of claim 1, wherein the device includes a material having a Brinell hardness at least 550.

18. A ballistic deflection system comprising:

a holster for a handgun; and a backing plate coupled to the holster, wherein at least a first portion of the backing plate is parallel to the holster, and a second portion of the backing plate is angled from the first portion of the backing plate below the holster.

19. The ballistic deflection system of claim 18, wherein the backing plate is attached to an outer side of the holster.

20. A ballistic deflection device configured to protect a user from injury when inserting or removing a firearm from a holster comprising:

a backing plate coupled configured to be coupled to the holster, wherein at least a first portion backing plate is angled at a non-zero angle to the trajectory of a bullet from a barrel of the firearm.

* * * * *